US008110762B2

(12) United States Patent
Besana et al.

(10) Patent No.: US 8,110,762 B2
(45) Date of Patent: Feb. 7, 2012

(54) LOW-VOLTAGE DEVICE WITH REINFORCED ROTATING ELEMENT

(75) Inventors: Stefano Besana, Terno d'Isola (IT); Alessio Bergamini, Ardesio (IT)

(73) Assignee: ABB Service S.r.l., Milan (IT)

( * ) Notice: Subject to any disclaimer, the term of this patent is extended or adjusted under 35 U.S.C. 154(b) by 853 days.

(21) Appl. No.: 11/870,509

(22) Filed: Oct. 11, 2007

(65) Prior Publication Data

US 2008/0087536 A1 Apr. 17, 2008

(30) Foreign Application Priority Data

Oct. 13, 2006 (IT) ..... BG2006A0054

(51) Int. Cl.
*H01H 1/22* (2006.01)

(52) U.S. Cl. ..... 200/244; 200/400

(58) Field of Classification Search ..... 200/244
See application file for complete search history.

(56) References Cited

U.S. PATENT DOCUMENTS 5,280,258 A * 1/1994 Opperthauser ..... 335/172
5,539,167 A * 7/1996 Hood et al. ..... 200/244
5,899,323 A 5/1999 Rakus
5,994,988 A 11/1999 Ferree et al.
6,262,642 B1 * 7/2001 Bauer ..... 335/16
7,683,281 B2 3/2010 Bresciani et al.

FOREIGN PATENT DOCUMENTS

DE 10150550 C1 12/2002
EP 0 903 763 A2 3/1999
EP 1098343 A1 5/2001

OTHER PUBLICATIONS

Extended European Search Report, European Application No. 07116296.0, dated Feb. 12, 2008.

* cited by examiner

*Primary Examiner* — Renee Luebke
*Assistant Examiner* — Lheiren Mae Caroc
(74) *Attorney, Agent, or Firm* — Connolly Bove Lodge & Hutz LLP

(57) ABSTRACT

A single-pole or multi-pole device for low-voltage systems, in particular a circuit breaker or a disconnector, which comprises: an outer casing containing for each pole at least one fixed contact and at least one mobile contact that can be coupled to/uncoupled from one another; a rotating element, defined by a shaped body comprising at least one seat for each pole of said switch, said seat being designed to house at least one mobile contact of a corresponding pole; a control mechanism operatively connected to said rotating element for enabling movement thereof; reinforcement elements positioned in said at least one seat of said mobile contact.

16 Claims, 11 Drawing Sheets

LOW-VOLTAGE DEVICE WITH REINFORCED ROTATING ELEMENT

FIELD OF THE INVENTION

The present invention relates to a device for low-voltage systems, in particular for a circuit breaker or a disconnector, having a reinforced rotating element.

BACKGROUND OF THE INVENTION

It is known that circuit breakers and disconnectors, hereinafter referred to as a whole as switches, comprise an outer casing and one or more electrical poles to each of which are associated at least one fixed contact and at least one mobile contact that can be coupled to/uncoupled from one another.

Circuit breakers of the known art moreover comprise control means that enable displacement of the mobile contacts, causing their coupling to or uncoupling from the corresponding fixed contacts. The action of said control means is traditionally exerted on a main shaft that is operatively connected to the mobile contacts so that, following upon its rotation, the mobile contacts will be brought from a first operative position to a second operative position, which are respectively characteristic of a configuration of switch open and of switch closed.

In the case of switches for low currents, indicatively up to 800 A, there exist solutions that cause the main shaft to coincide with the mobile contacts, giving rise to a rotating element made of insulating material capable of guaranteeing both dielectric separation between the phases and, of course, proper transmission of the movements and resistance to the forces involved. The rotating element is usually supported by structural parts of the outer casing of the switch, which basically define areas of bearing with the rotating element itself. Switches of this type present considerable advantages, such as, for example, a limited number of parts and a limited overall encumbrance.

The indicative technical limit of 800 A for the switches that make use of the rotating element derive from the fact that, beyond this limit, there would be required of the rotating element performance of mechanical resistance that is scarcely compatible with structural materials of an insulating type that are to have competitive costs.

From a practical standpoint, the requirement of higher mechanical characteristics has partially been met by introducing metal reinforcement bars, passing through the rotating element itself. The metal reinforcement bars pose, however, problems of interference with the characteristics of electrical insulation between the poles. In practice, only modest increases of performance are obtained with costly and industrially complex solutions.

Another road followed in the known art for bestowing upon the rotating element higher mechanical characteristics is that of increasing the radial dimensions thereof; solutions of this second type tend, however, to introduce greater friction and jeopardize the general efficiency of the switch.

A more advanced solution, described in the patent application No. BG2005A000026 enables extension of the use of the rotating element also to switches for currents decidedly higher than 800 A by introducing bearings that suspend the rotating element itself from the control members. In particular, the latter solution reduces the friction and prevents the stresses from being transmitted by the contacts to the rotating element directly onto critical areas of the switch, such as, for example, the joints of the containment means.

Even though the latter solution enables exploitation of the switch over a particularly extensive range of performance levels, there remain in any case physical limits of use linked not so much to the rated current as rather to the electrodynamic strength and to the breaking power of the switch. A good electrodynamic strength would require in fact the use of particularly strong contact springs, whilst the breaking power of the switch is linked, among other things, to the capacity of the rotating element to absorb without damage the mechanical stresses transmitted by the contacts following upon electrodynamic repulsion. In practice, these limits are substantially dictated by the resistance of the joints between the pins of the individual poles and the rotating element itself. The design data must in fact guarantee that the plastic material that makes up the rotating element works exclusively in the so-called region of elastic behaviour. Once said limit is exceeded, the so-called phenomena of yielding and failure would in fact start.

It may be readily noted how this limit is relatively modest even with the use of high-quality plastic materials, such as, for example, the so-called moulding compounds with a base of unsaturated polyester.

Since the electrodynamic strength and the electrodynamic repulsion of the mobile contacts cause considerable stresses, above all of thrust and tugging, in the area of the rotating element in which the pins are fixed, it is clear that wishing to achieve further increased performance for the switch it is necessary to increase the resistance to stresses of the rotating element, guaranteeing at the same time the electrical insulation between the phases.

SUMMARY OF THE INVENTION

The main technical aim of the present invention is to provide a switch that will enable the limits and the drawbacks just referred to be overcome.

In the framework of this aim, a purpose of the present invention is to provide a switch that will present a compact structure, that can be easily assembled and is made up of a limited number of components.

Another task of what forms the subject of the present invention is to provide a switch with improved characteristics of electrodynamic strength.

A further task of what forms the subject of the present invention is to provide a switch with improved characteristics of breaking power.

Not the least important purpose of what forms the subject of the present invention is to provide a switch that will present high reliability, and that is relatively easy to produce at competitive costs.

The above task, as well as the above and other purposes that will appear more clearly in what follows, are achieved through a single-pole or multi-pole device for low-voltage systems, in particular a circuit breaker or a disconnector, characterized in that it comprises:

- an outer casing containing for each pole at least one fixed contact and at least one mobile contact that can be coupled to/uncoupled from one another;
- a rotating element, defined by a shaped body comprising at least one seat for each pole of said switch, said seat being designed to house at least one mobile contact of a corresponding pole;
- a control mechanism operatively connected to said rotating element for enabling movement thereof; and
- reinforcement elements positioned in said at least one seat of each pole of the rotating element.

In the device according to the invention, thanks to the presence of the reinforcement elements, the problems typical of switches of the known art are overcome. In particular, the reinforcement elements increase the rigidity of the areas subject to stress of the shaped body of the rotating element, enabling increase of the performance of the switch, in particular in terms of electrodynamic strength and breaking power.

In practice, the reinforcement elements, appropriately positioned in the seats of the mobile contacts enable distribution of the stresses, and in particular the actions of thrust or of tugging that are exerted on the shaped shaft of the rotating element.

Further characteristics and advantages of the invention will emerge more clearly from the ensuing description of preferred, but not exclusive, embodiments of a device according to the invention, illustrated by way of example in the annexed drawings. In the attached figures the invention is illustrated with reference to a low-voltage circuit breaker, without thereby wishing to limit in any way application thereof also to other types of low-voltage devices, such as, for example, disconnectors. Furthermore, even though reference is herein made to multi-pole switch, the present invention is applicable also to single-pole devices.

DESCRIPTION OF THE PREFERRED EMBODIMENTS

Figure 1:
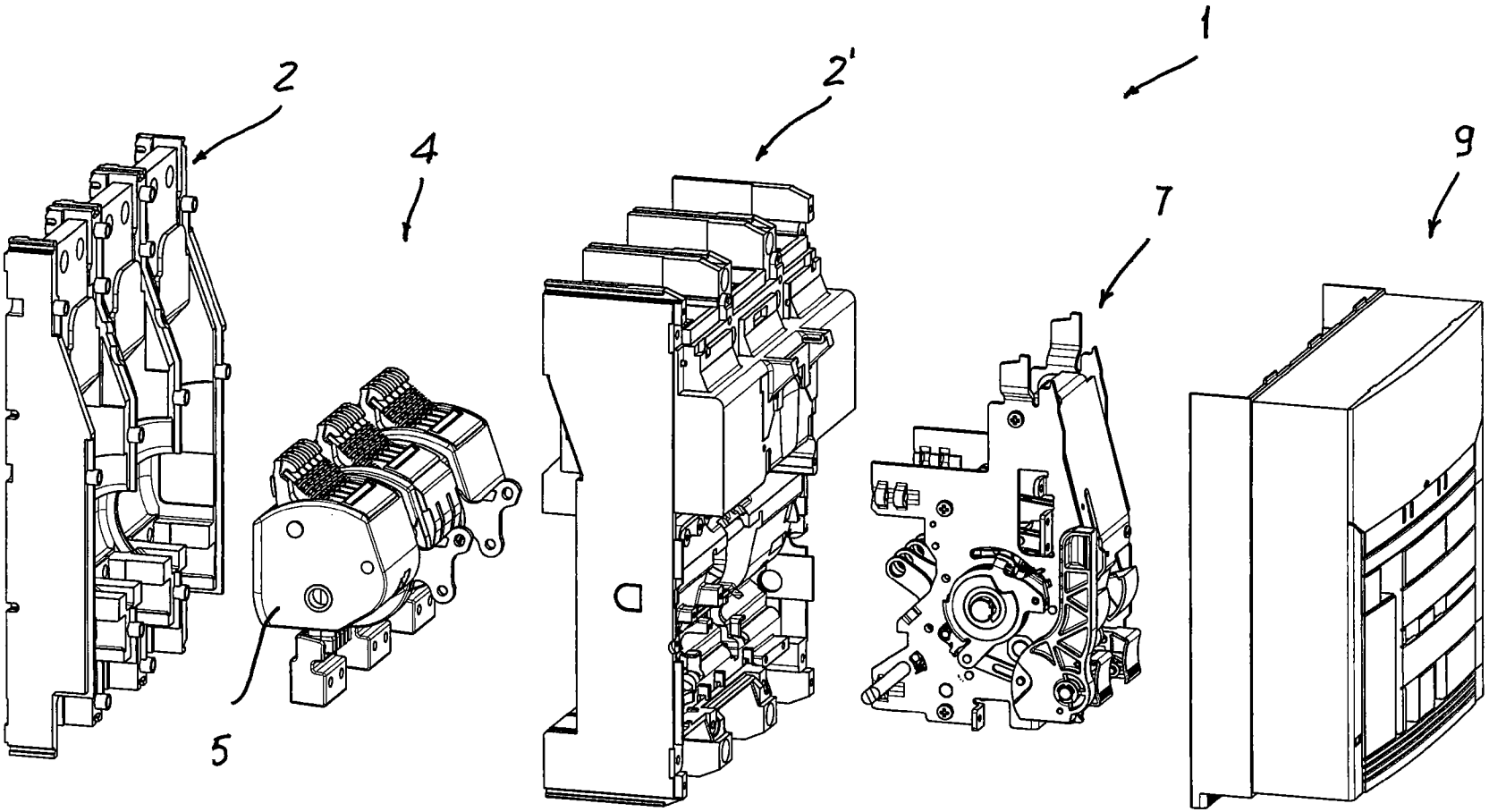
FIG. 1 is an exploded view of a low-voltage circuit breaker according to the invention.

With reference to the attached figures, the device for low-voltage systems according to the invention, in this case a circuit breaker 1, comprises an outer casing that in the embodiment illustrated comprises two half-shells 2 and 2'. The half-shells house a plurality of poles, in this case three, each of said poles containing at least one fixed contact and at least one mobile contact 3 that can be coupled to/uncoupled from one another. The mobile contact 3 can be made of a single piece or else of a plurality of pieces adjacent to one another, as clearly illustrated in FIG. 2.

The circuit breaker moreover comprises a rotating element 4 that is defined by a shaped body 5. At each pole of the circuit breaker, the shaped body 5 comprises at least one seat 6 that is designed to house at least the mobile contact 3 of the corresponding pole. In order to enable movement of the rotating element 4, the circuit breaker 1 also comprises a control mechanism 7 that is operatively connected to said rotating element 4. Furthermore, a closing mask 9 is generally present; said mask 9 is usually applied on one of the half-shells 2' and can if necessary be easily removed by an operator in order to gain access to the internal parts of the circuit breaker 1.

For a detailed description of an example of switch the reader is referred to the patent application No. BG2005A000026, the description of which is incorporated herein for reference.

The circuit breaker according to the invention moreover comprises reinforcement elements, which are positioned in the seat 6 of the mobile contact 3 made in the shaped body 5 of the rotating element 4. In the device according to the invention, the reinforcement elements are in general shaped and positioned in such a way as to favour the strength of the areas subject to stress of said shaped body 5.

Figure 2:
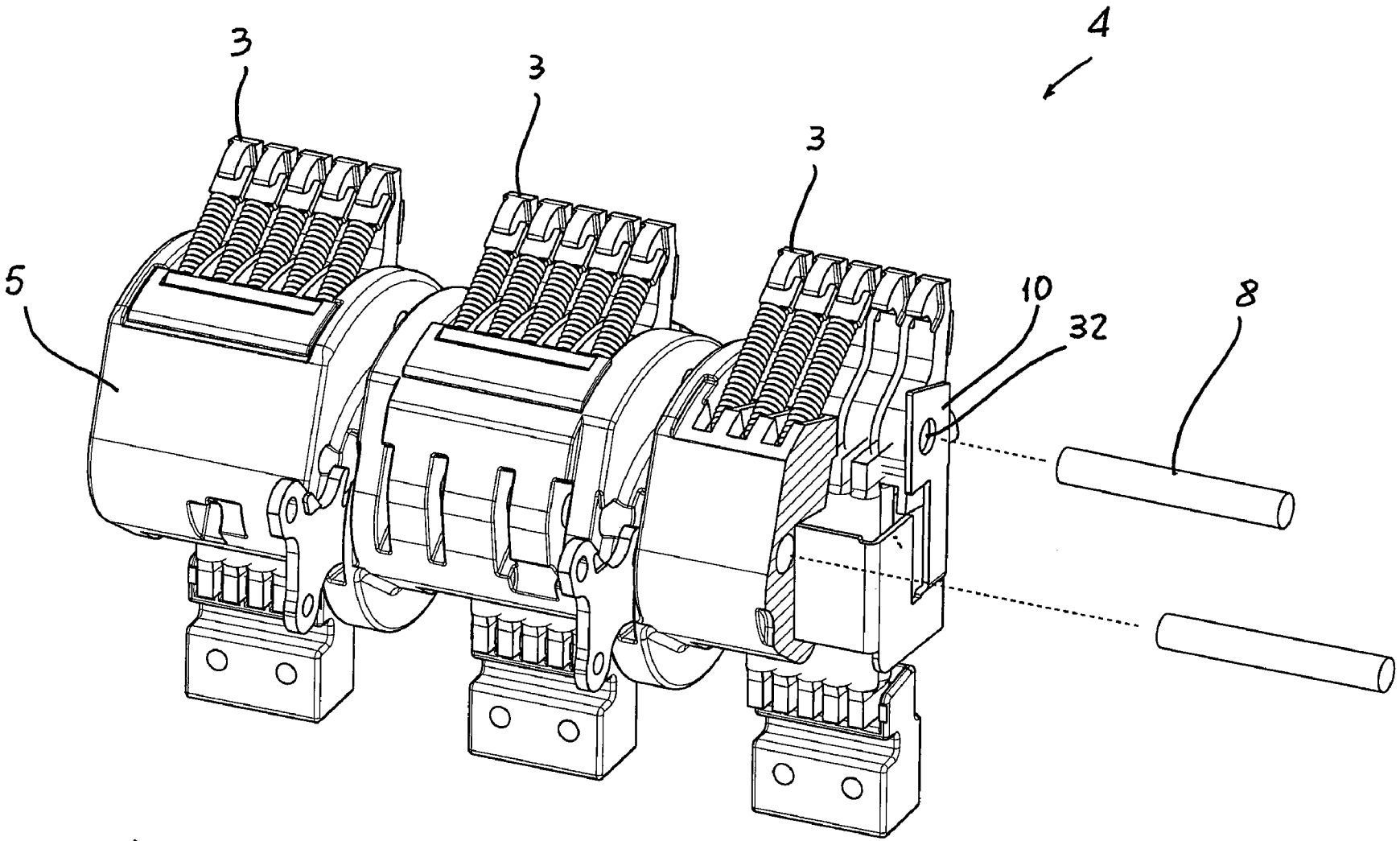
FIG. 2 is a partial cross-sectional view of a rotating element of a low-voltage device according to the invention.
Figure 7:
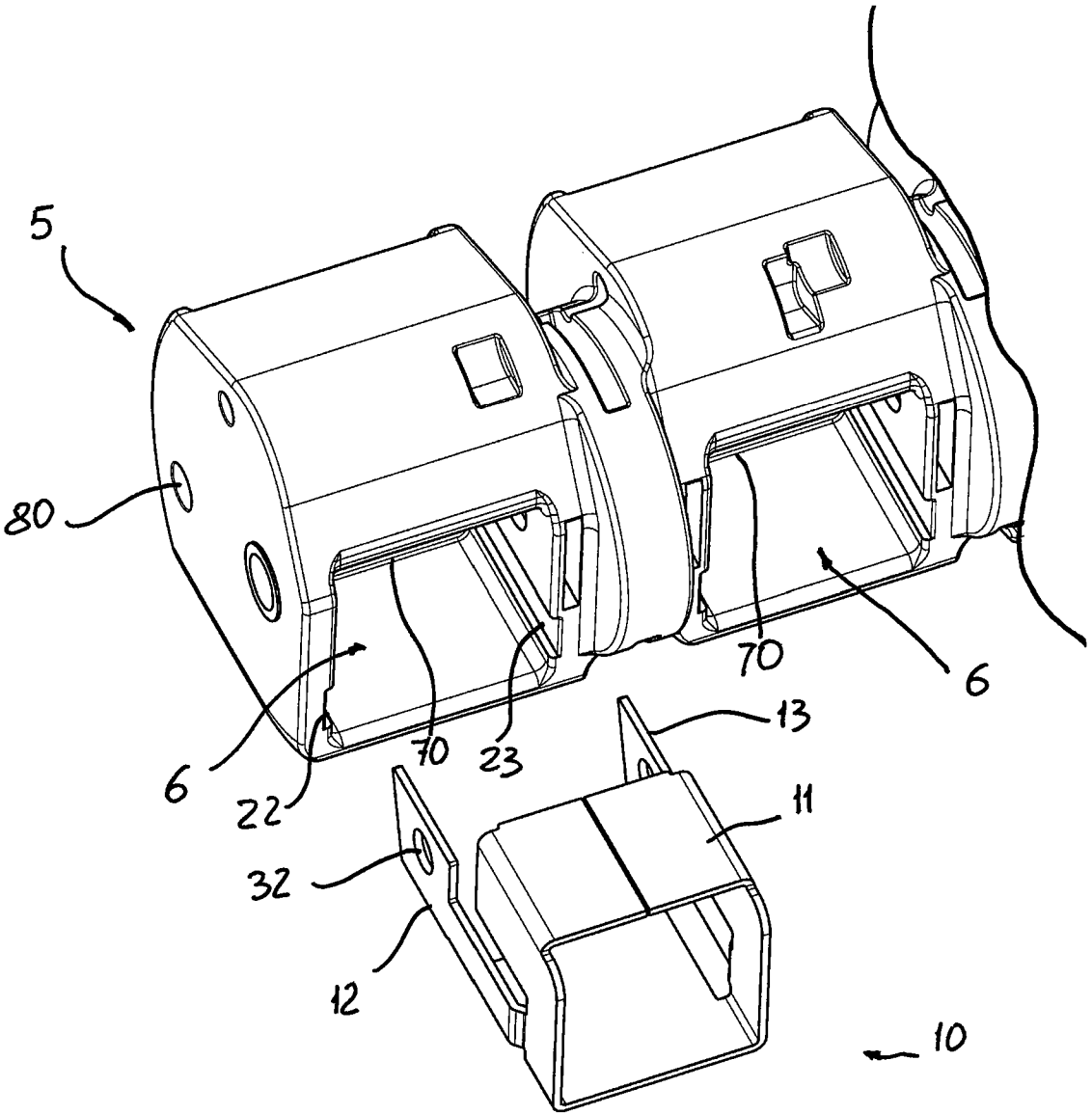
FIG. 7 is a view of a portion of rotating element and of a corresponding reinforcement element according to the embodiment of FIG. 3.

With reference to FIGS. 2 and 7, said rotating element 4 usually comprises at least one driving pin 8 that passes through corresponding holes 80, defined in said shaped body 5. In this case, in practice, the reinforcement elements interact operatively with said driving pin 8 and with the shaped body 5, and distribute the action of thrust or of tugging on an extensive and not concentrated portion of the rotating element 4. With the expression "interact operatively with said driving pin 8 and with the shaped body 5" is meant that, thanks to the presence of the reinforcement elements, the stresses, instead of being concentrated in the proximity of the hole 80 for passage of the driving pin 8, are distributed over a relatively extensive region of the shaped body 5.

The shape, dimensions and location of the reinforcement elements can be different according to the needs. For example, with reference to FIGS. 3, 4 and 7 the reinforcement elements can substantially comprise a first shaped body 10, which has a hollow portion with substantially rectangular cross section 11. The outer surface of the portion 11 is shaped so as to substantially mate with the inner surface of the seat 6 made in the shaped body 5 of the rotating element (see FIG. 7). The shaped body 10 of the reinforcement element moreover comprises a first tab 12 and a second tab 13, which extend from the hollow portion 11 of the shaped body 10. With reference to FIG. 7, the tabs 12 and 13 preferably project from the width of the rectangular hollow portion 11 so as to engage, for example, by snap action, in corresponding housings 22 and 23, defined in the seat 6.

Preferably, defined on said first tab 12 and second tab 13 are a first hole 32 and second hole 33 for passage of said driving pin 8. In this way, the stresses and the twisting moments generated in a position corresponding to the driving pin 8, instead of being concentrated on a limited area adjacent to the hole 80, can be distributed over a far more extensive surface.

Preferably, the shaped body 10 of the reinforcement element also comprises plane regions 60 substantially perpendicular to the development of the rectangular hollow portion 11, designed to co-operate bearing upon corresponding plane regions 70 of the seats 6. In this way, the stresses generated in a position corresponding to the driving pin 8 can be discharged in particular on particularly massive areas of the shaped body 5.

Figure 5:
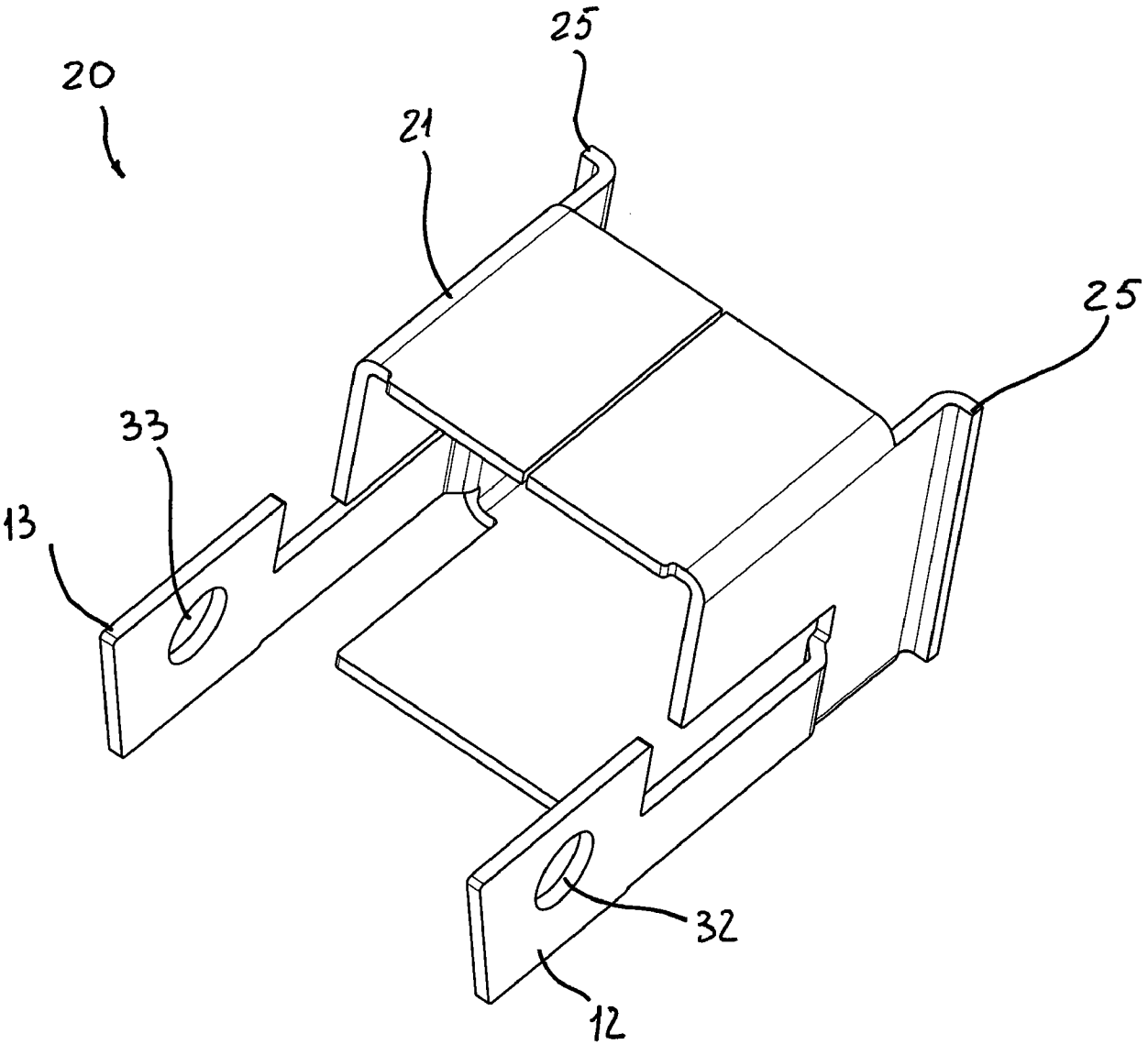
FIG. 5 is a perspective view of a second embodiment of a reinforcement element used in a low-voltage device according to the invention.

With reference to FIG. 5, in order to improve further the distribution of the stresses over the rotating element, at least one part of the outer perimeter of said hollow portion 21 of the reinforcement element 20 has a bent-over edge 25 designed to co-operate with a corresponding coupling surface, defined on the shaped body 5. The term "outer perimeter" is intended to indicate the area of hollow portion 21 of the element 20 closer to the mouth of the seat 6, once the reinforcement element 20 has been inserted in said seat 6 according to the modalities illustrated in FIG. 7.

Figure 3:
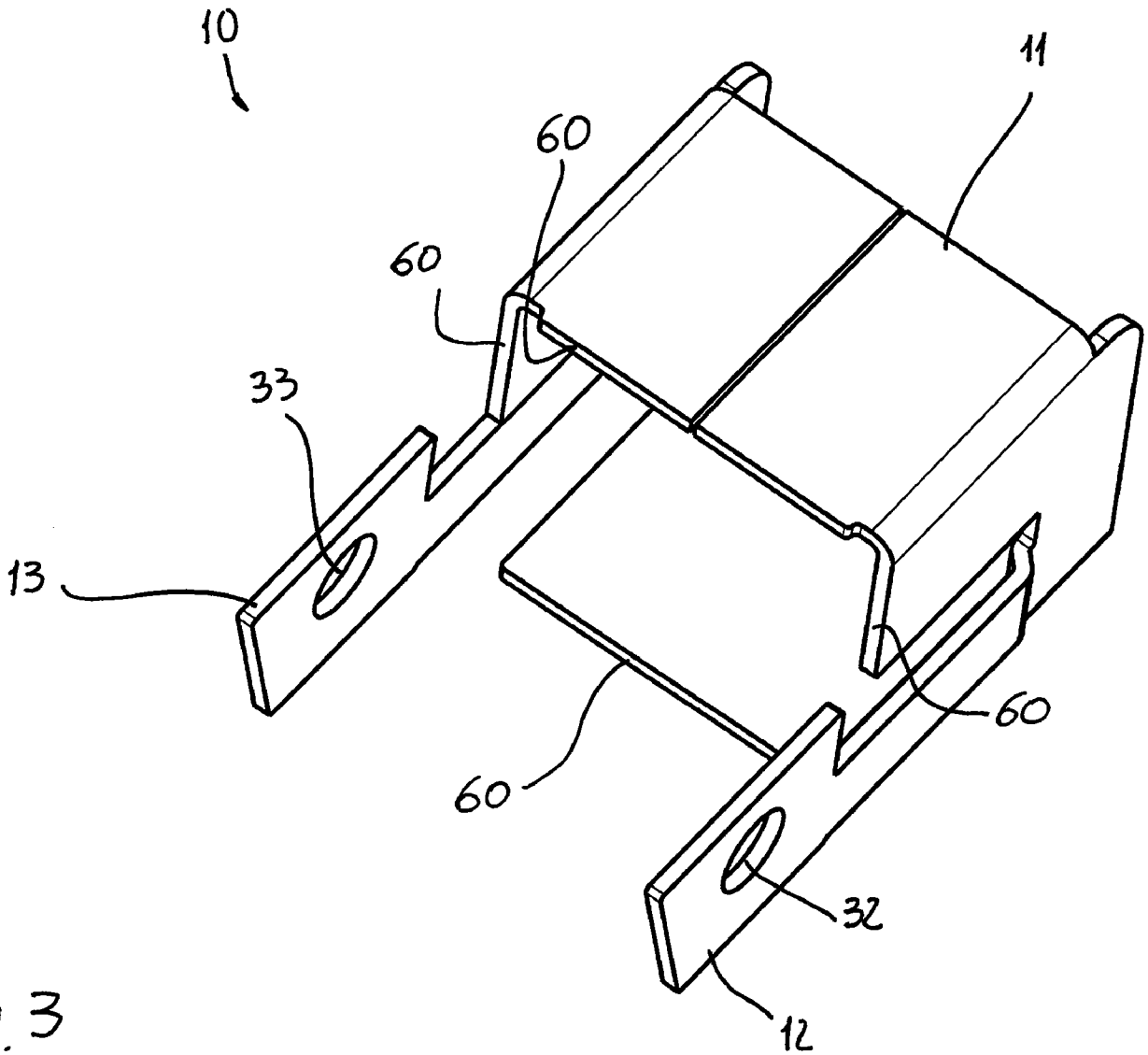
FIG. 3 is a perspective view of a first embodiment of a reinforcement element used in a low-voltage device according to the invention.
Figure 4:
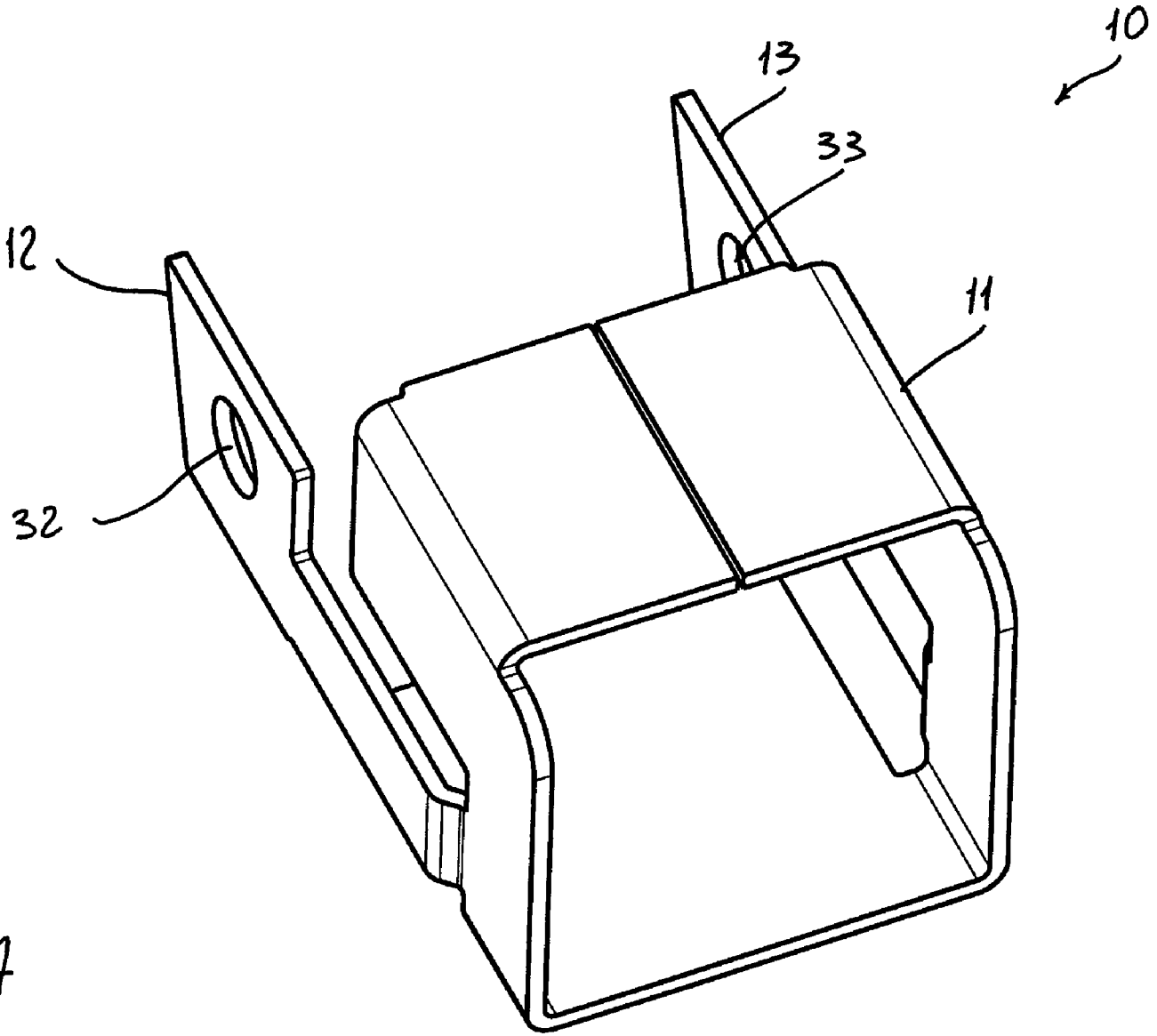
FIG. 4 is a further view of the element of FIG. 3.

The reinforcement element illustrated in FIGS. 3 to 5 can advantageously be made of a single piece, appropriately shaped and bent. Once inserted in the seat 6, the reinforcement element easily remains in position thanks to the interaction between the tabs 12, 13 and the corresponding seats 22, 23, as well as thanks to the interaction between the outer surface of the hollow portion 11, 21 and the inner surface of the seat 6.

Figure 6:
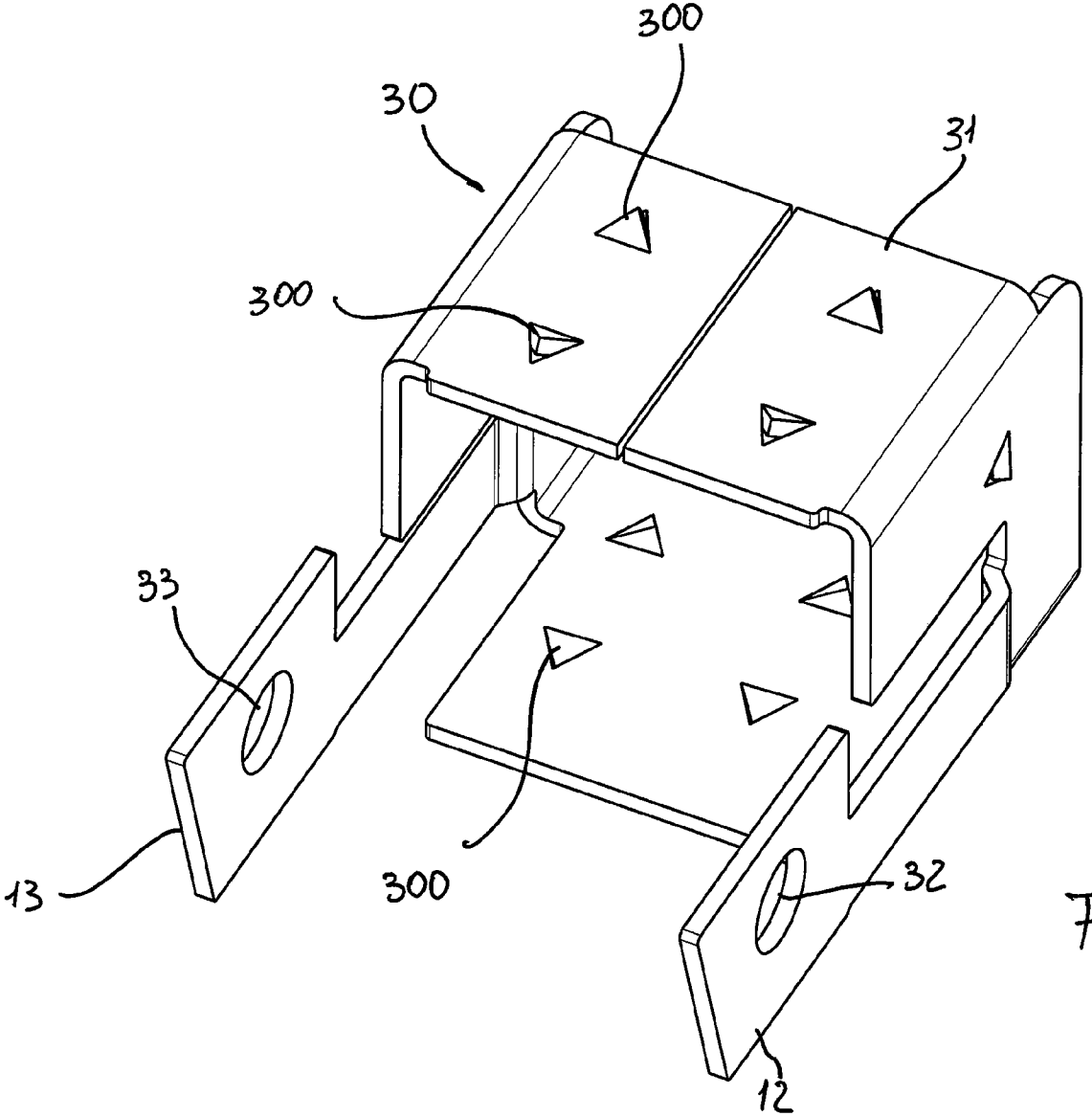
FIG. 6 is a perspective view of a third embodiment of a reinforcement element used in a low-voltage device according to the invention.

According to an alternative embodiment, illustrated in FIG. 6, the reinforcement element 30 can advantageously comprise crimping means 300, designed to favour coupling of the reinforcement element itself and the shaped body 5. This is particularly advantageous in the case where the positioning of the reinforcement element within the seat 6 is obtained by co-moulding, via insertion of the element 30 in the mould of the shaped body 5 of the rotating element 4.

Figure 8:
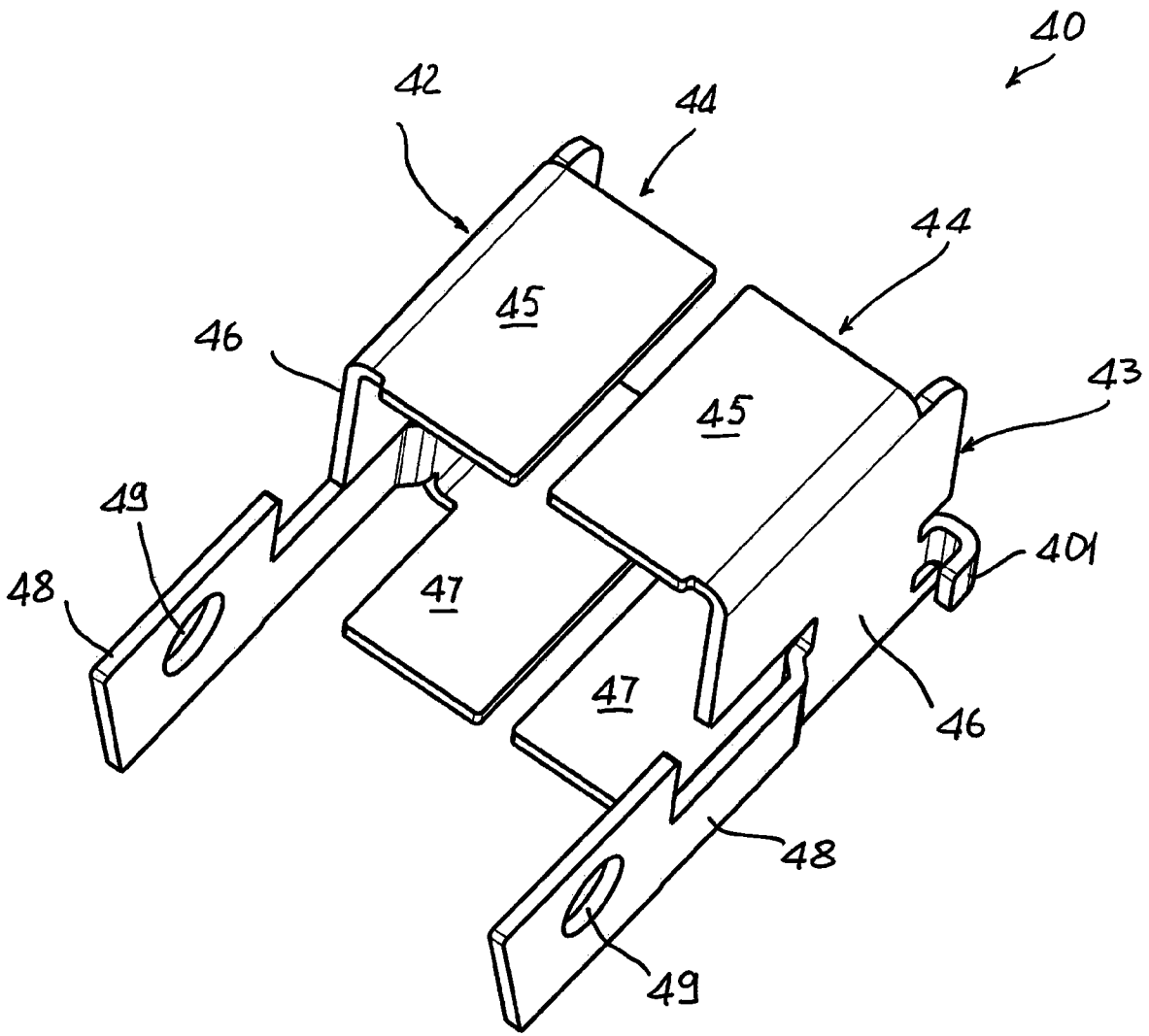
FIG. 8 is a perspective view of a fourth embodiment of a reinforcement element used in a low-voltage device according to the invention.
Figure 9:
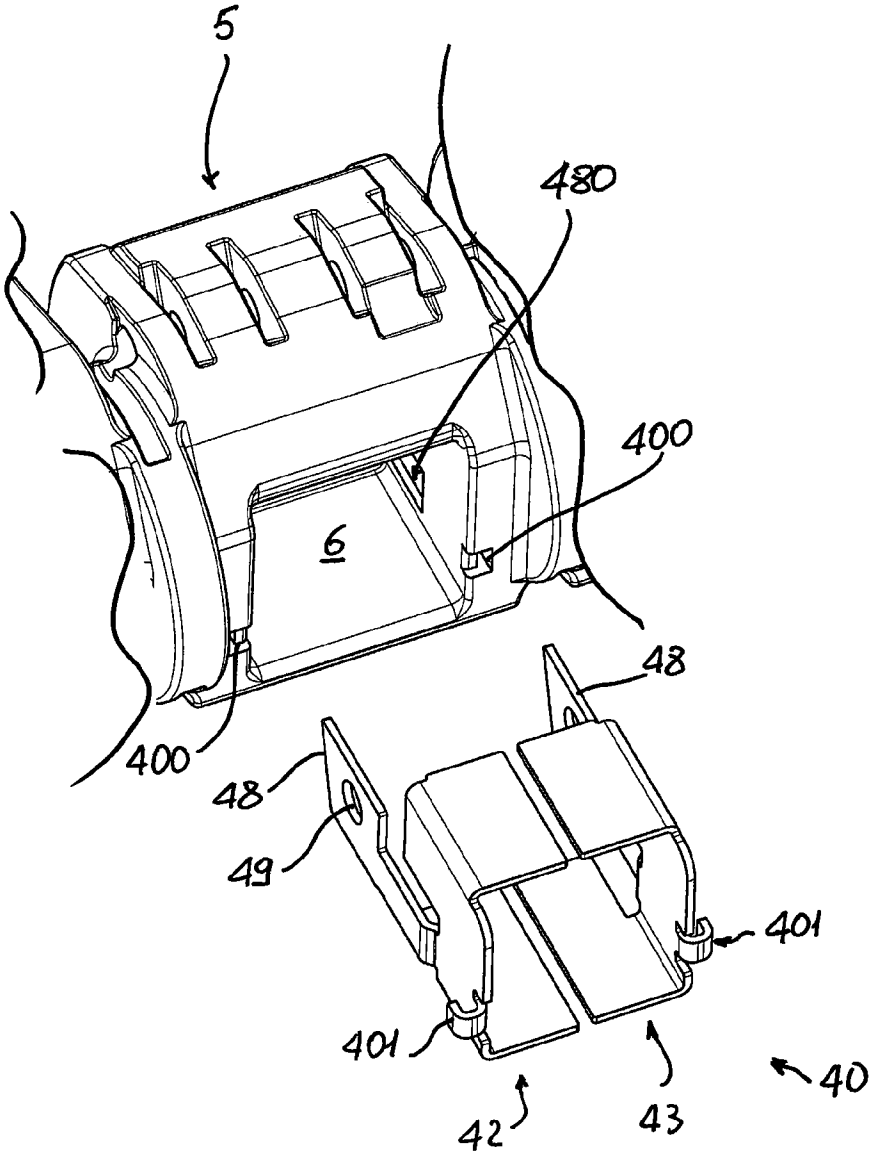
FIG. 9 is a view of a portion of rotating element and of a corresponding reinforcement element according to the embodiment of FIG. 8.

An alternative embodiment, illustrated in FIGS. 8 and 9, envisages that the reinforcement elements 40 comprise a second shaped body 42 and a third shaped body 43. Each of said second and third shaped bodies 42, 43 has a first hollow portion 44 with substantially U-shaped cross section, defined by a first wall 45, a second wall 46 and a third wall 47 substantially perpendicular to one another. The outer surface of the hollow portion 44 is made so as to mate substantially with the inner surface of said seat 6. A third tab 48 extends from said second wall 46 and engages, for example, by snap action, in corresponding housings 480, defined in the seat 6 of the shaped body 5. As illustrated in FIG. 9, the second and third shaped bodies 42, 43 are inserted in the seat 6 so that the respective hollow portions 44 face one another.

Preferably, defined on said third tab 48 is a third hole 49 for passage of said driving pin 8. Like the embodiment previously described, the stresses and in particular the actions of thrust and of tugging generated in a position corresponding to the driving pin 8, instead of being concentrated on a limited area adjacent to the hole 80, can thus be distributed over a far more extensive surface.

In order to improve the ease of positioning in the seat 6, the second and third shaped bodies 42, 43 can advantageously have engagement means 401 designed to engage in corresponding housings 400, defined on said shaped body 5 of said rotating element.

Figure 10:
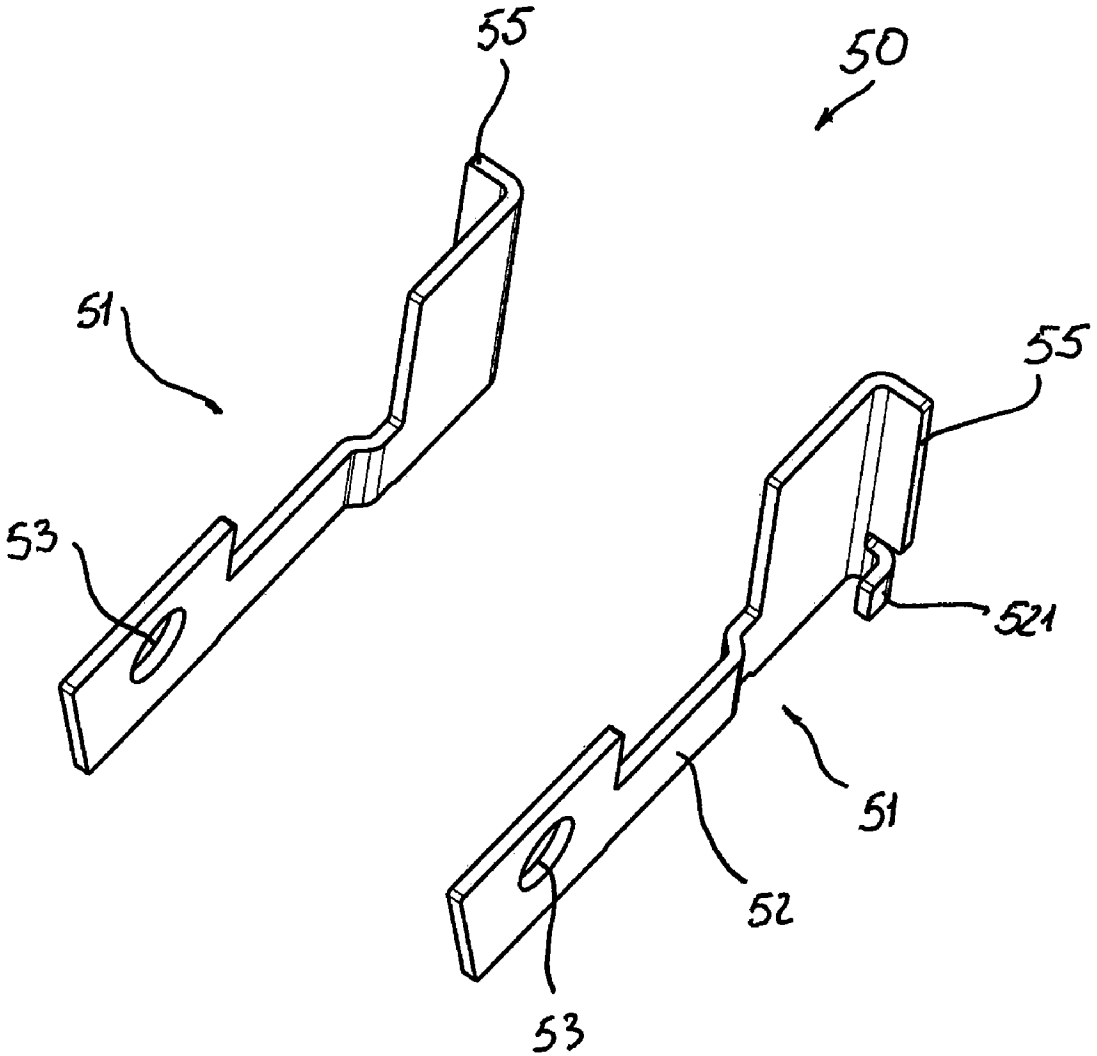
FIG. 10 is a perspective view of a fifth embodiment of a reinforcement element used in a low-voltage device according to the invention.
Figure 11:
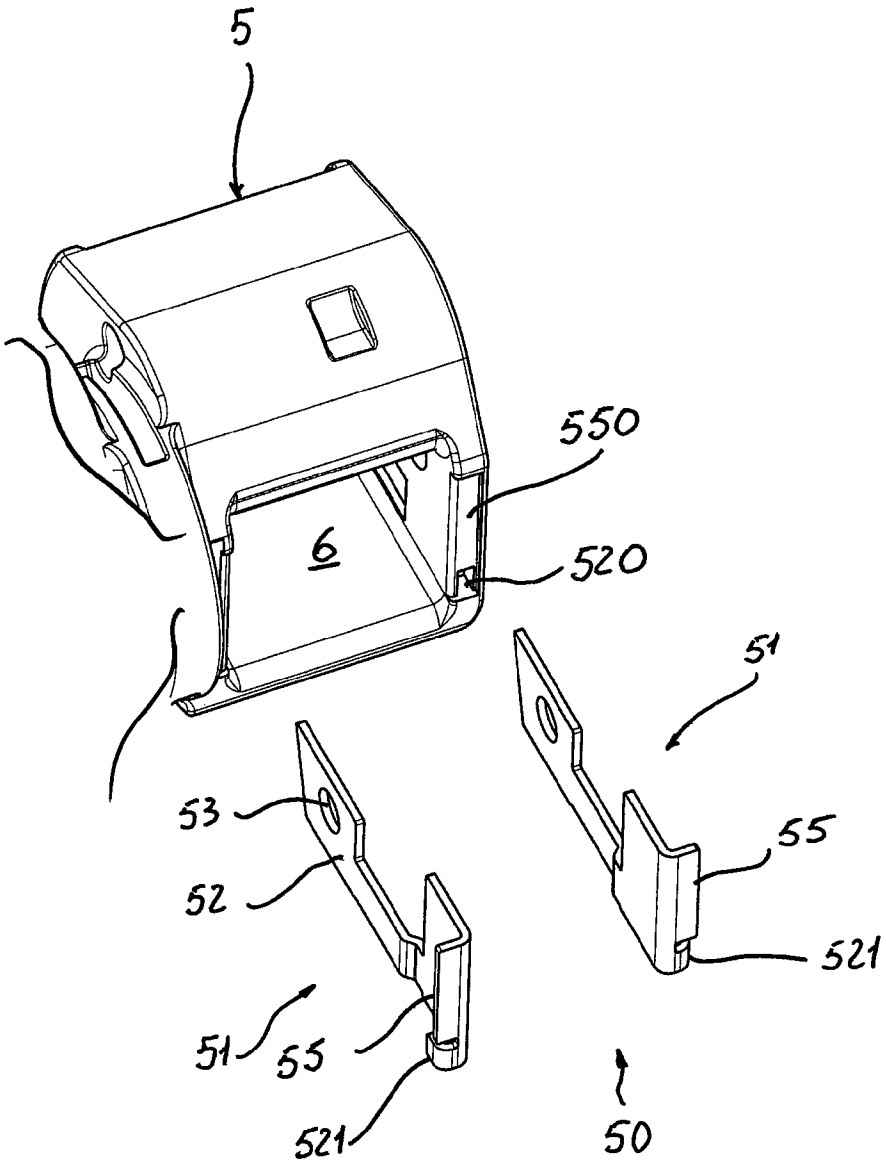
FIG. 11 is a view of a portion of rotating element and of a corresponding reinforcement element according to the embodiment of FIG. 10.

A further alternative embodiment, illustrated in FIGS. 10 and 11, envisages that the reinforcement elements 50 comprise a fourth plate-shaped body 51 that has a surface 52 substantially mating with an inner surface of said seat 6. As illustrated in the figures, it is preferable for the reinforcement elements to comprise two plate-shaped bodies 51, positioned on two opposed sides of the seat 6. In order to improve the ease of positioning in the seat 6, the plate-shaped bodies 51 moreover comprise engagement means 521 designed to engage in corresponding housings 520, defined on the shaped body 5 of said rotating element.

Preferably, in order to optimize the distribution of the stresses over a surface that is as extensive as possible, defined on said fourth plate-shaped body 51 is a fourth hole 53 for passage of said driving pin 8. Furthermore, once again in order to improve further the distribution of the stresses over the rotating element, the fourth shaped body 51 has at least one portion of bent-over edge 55, designed to co-operate with a corresponding coupling surface 550, defined on said shaped body 5.

Preferably said reinforcement elements (10, 20, 30, 40, 50) are made of metal material, most preferably steel.

On the basis of what has been described above, it may be seen that the single-pole or multi-pole device for low-voltage systems, in particular a circuit breaker or a disconnector, according to the invention, enables the problems typically present in switches of the known art to be solved in so far as it makes available a rotating element in which the distribution of the stresses and the strength are optimized.

On the basis of the description provided, other characteristics, modifications or improvements are possible and evident to the average person skilled in the branch. Said characteristics, modifications and improvements are hence to be considered part of the present invention. In practice, the materials used, as well as the contingent dimensions and shapes, may be any whatsoever according to the needs and the state of the art.

We claim:

1. A single-pole or multi-pole switching device for low-voltage systems, comprising:

an outer casing containing for each pole at least one fixed contact and at least one mobile contact that can be coupled to/uncoupled from one another;

a rotating element comprising a shaped body including at least one seat for each pole of said switching device, said seat being designed to house at least one mobile contact of a corresponding pole;

a control mechanism, operatively connected to said rotating element for enabling movement thereof; and reinforcement elements positioned in said at least one seat of said mobile contact;

wherein said rotating element comprises at least one driving pin of the mobile contact passing through corresponding holes being defined in said shaped body, and wherein said reinforcement elements comprise holes for passage of said driving pin therethrough.

2. The device according to claim 1, wherein said reinforcement elements interact operatively with said driving pin and with said shaped body.

3. The device according to claim 1, wherein said reinforcement elements increase the strength of areas subject to stress of said shaped body.

4. The device according to claim 1, wherein said reinforcement elements distribute the mechanical stresses exerted on said shaped body.

5. The device according to claim 1, wherein said reinforcement elements comprise a first shaped body having a hollow portion with substantially rectangular cross section, an outer surface of which substantially mates with an inner surface of said seat, and a first tab and a second tab that extend from said hollow portion and engage in corresponding housings, defined in said seat.

6. The device according to claim 5, wherein a first hole and a second hole for passage of said driving pin are defined on said first tab and said second tab.

7. The device according to claim 6, wherein at least one part of an outer perimeter of said hollow portion has a bent-over edge, designed to cooperate with a corresponding coupling surface, defined on said shaped body.

8. The device according to claim 1, wherein said reinforcement elements comprise a second shaped body and a third shaped body, said second and third shaped bodies each having a first hollow portion with substantially U-shaped cross section, defined by a first wall, a second wall, and a third wall substantially perpendicular to one another, an outer surface of said hollow portion substantially mating with an inner surface of said seat, a third tab extending from said second wall and engaging in corresponding housings, defined in said seat, said second and third shaped bodies being inserted in said seat so that the respective U-shaped hollow portions face one another.

9. The device according to claim 8, wherein a third hole for passage of said driving pin is defined on said third tab.

10. The device according to claim 9, wherein said second and third shaped bodies have engagement means, designed to engage in corresponding housings, defined on said shaped body of said rotating element.

11. The device according to claim 8, wherein said reinforcement elements comprise a fourth plate-shaped body that has a surface substantially mating with an inner surface of said seat, said fourth shaped body moreover comprising engagement means, designed to engage in corresponding housings, defined on said shaped body of said rotating element.

12. The device according to claim 11, wherein a fourth hole for passage of said driving pin is defined on said fourth plate-shaped body.

13. The device according to claim 12, wherein said fourth shaped body 1 has at least one portion of a bent-over edge, designed to co-operate with a corresponding coupling surface, defined on said shaped body.

14. The device according to claim 1, wherein said reinforcement elements comprise means for crimping to said shaped body, designed to favour coupling between said reinforcement elements and said shaped body.

15. The device according to claim 1, wherein said reinforcement elements are made of metal material.

16. The device according to claim 1, wherein said reinforcement elements are made of steel.

* * * * *

UNITED STATES PATENT AND TRADEMARK OFFICE

CERTIFICATE OF CORRECTION

PATENT NO. : 8,110,762 B2
APPLICATION NO. : 11/870509
DATED : February 7, 2012
INVENTOR(S) : Stefano Besana et al.

It is certified that error appears in the above-identified patent and that said Letters Patent is hereby corrected as shown below:

On the Title Page:

Item (73) Assignee: "ABB Service S.r.l." should read -- ABB S.P.A. --.

Signed and Sealed this
Sixteenth Day of April, 2013

Teresa Stanek Rea
*Acting Director of the United States Patent and Trademark Office*